United States Patent [19]

Meister

[11] 4,157,791

[45] Jun. 12, 1979

[54] YARN WINDER

[76] Inventor: Douglas L. Meister, 46 Linda Ave., Fairview, Pa. 16415

[21] Appl. No.: 820,093

[22] Filed: Jul. 29, 1977

[51] Int. Cl.[2] ..... B65H 54/64

[52] U.S. Cl. ..... 242/2; 156/170; 156/433

[58] Field of Search ..... 242/2, 3, 7.02; 156/170, 186, 431, 433

[56] References Cited

U.S. PATENT DOCUMENTS

| | | | |
|---|---|---|---|
| 2,788,836 | 4/1957 | Trevaskis et al. | 156/170 |
| 2,855,158 | 10/1958 | Pumphrey et al. | 242/2 |
| 2,966,935 | 1/1961 | Wiltshire | 156/433 |
| 3,140,058 | 7/1964 | Courtney | 242/2 |
| 3,333,778 | 8/1967 | Levenetz et al. | 242/3 |

FOREIGN PATENT DOCUMENTS

| | | | |
|---|---|---|---|
| 710664 | 6/1954 | United Kingdom | 242/2 |

*Primary Examiner*—Billy S. Taylor

*Attorney, Agent, or Firm*—Charles L. Lovercheck

[57] ABSTRACT

A thread winder having a hollow sphere divided into two halves with a spool inside concentric with the sphere. The sphere is carried on a yoke so that it can be swung about one of its axis and one-half of the sphere is rotated about the axis perpendicular to the equator line where the two halves join. The spool is rotated inside the sphere and yarn is fed through an opening in the rotatable half of the sphere. Thus, as the sphere swings and the spool rotates, the thread is wound on the spool and distributed by the swinging movement of the sphere relative to the spool.

5 Claims, 3 Drawing Figures

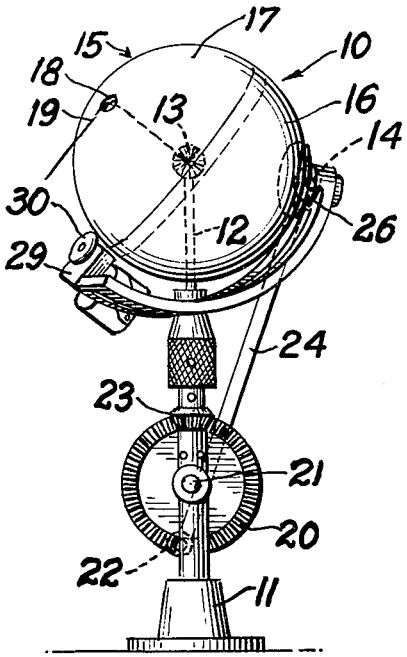
FIG. 1.
FIG. 2.
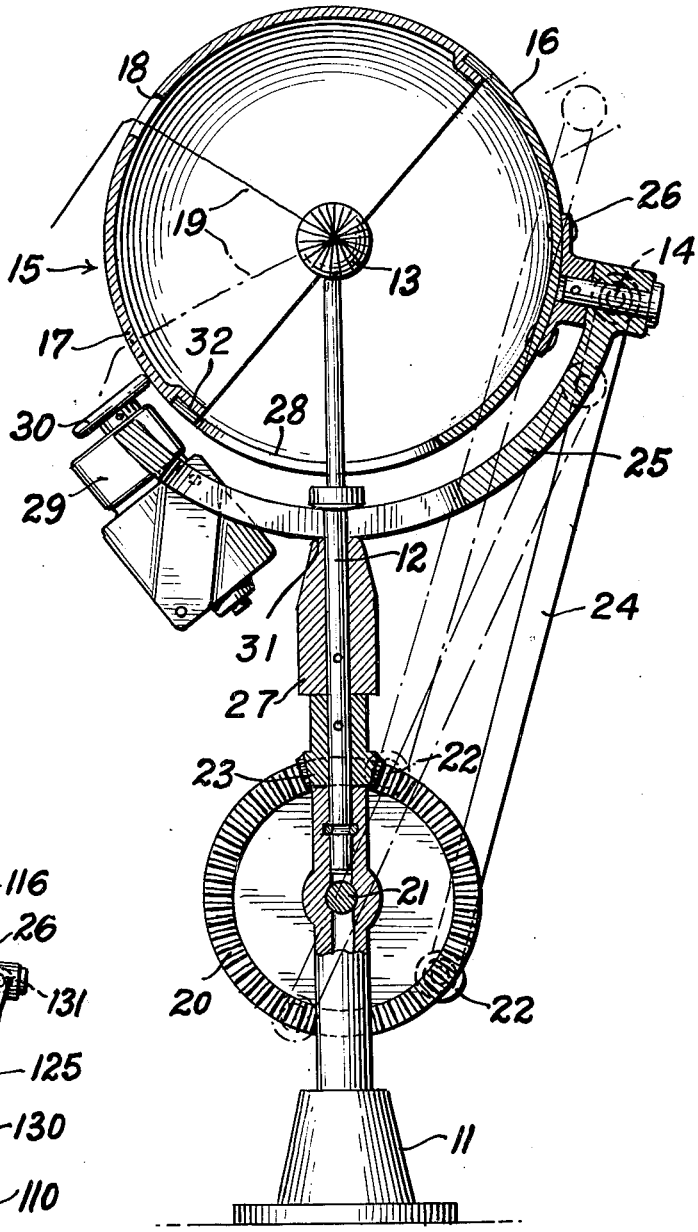
FIG. 3.
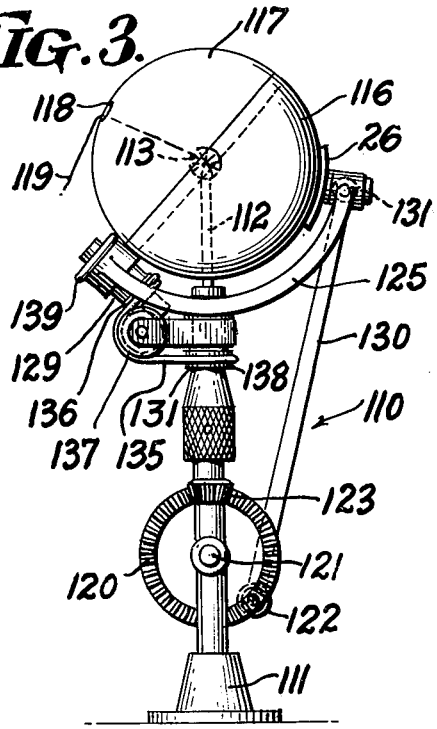

YARN WINDER

BACKGROUND OF THE INVENTION

The thread winder disclosed herein constitutes an improvement over the following U.S. Pat. Nos.: 2,634,916, 2,966,935 2,634,923, 3,043,527 2,788,836, 3,133,236 2,901,190, 3,140,058.

These patents show various yarn winding devices but none of them show a yarn winding device that will wind the yarn as efficiently and evenly as applicant's invention discloses herein.

OBJECTS OF THE INVENTION

It is an object of the invention to provide an improved yarn winder.

Another object of the invention is to provide a yarn winder that is simple in construction, economical to manufacture, and simple and efficient to use.

Another object of the invention is to provide a yarn winder that distributes the thread uniformly over a spool thereby providing a symmetrical ball of yarn that is pleasing in appearance.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a side view of the yarn winder according to the invention.

FIG. 2 is a longitudinal, cross-sectional view of the yarn winder shown in FIG. 1.

FIG. 3 is a view of another embodiment of the winder.

DETAILED DESCRIPTION OF THE DRAWINGS

Now, with more particular reference to the drawings, the yarn winder is indicated generally at 10. It is made up of a base 11, which supports the stem 12. Stem 12 rotates on the base about a vertical axis. The spool 13 is supported inside the sphere 15, which is divided into a fixed hemisphere 16 and a rotation hemisphere 17. The rotation hemisphere 17 has an opening 18 offset about five (5°) degrees from a radius perpendicular to its equator. Its equator is defined by bearing 32. The thread or yarn 19 can extend through the opening 18.

The ring gear 20 is rotatable about the axis 21 by means of a handle 22 and ring gear 20 drives a pinion 23 which is fixed to the shaft of stem 12.

The fixed half 16 of the sphere is carried on cradle 25, which is fixed to the hemisphere 16 by a stud 26. The cradle 25 rests and slides on the upper surface of bearing 27. Stud 26 is received in the cradle 25.

Fixed half 16 has a slot 28 therein through which the stem 12 extends and may slide. the rotation half 17 of the hemisphere is rotated by a motor 29, which drives friction wheel 30 causing hemisphere 17 to rotate on the sliding bearing surface 32 defining a line around the equator of said rotation half and said fixed half. The motor has a friction wheel 30 which makes frictional engagement with the outer periphery of the rotation half 17 and rotates it about its equator. A crank pin 14 is fixed to the cradle 25, and the connecting rod 24 engages the crank pin 14. The connecting rod 24 has its other end connected to the ring gear 20, and when the ring gear 20 is rotated, it swings the cradle 25 and with it the fixed hemisphere 16. When the ring gear 20 rotates, the crank pin 14 moves about an arcuate path, thereby causing the sphere 15 to oscillate through an arcuate path of approximately 90°, in positions shown in phantom lines FIG. 2.

In operation, the motor 29 is turned on, thus friction wheel 30 will rotate the movable hemisphere 17 about the hemisphere. Then, as the handle 22 rotates ring gear 20, the pinion 23 will rotate spool 13 through shaft 12, and at the same time the connecting rod 24 will oscillate the entire sphere by sliding the cradle 25 to and fro on the bearing surface 31 through angle 19. Thus, the yarn will be evenly distributed on the spool.

It will be seen that the yarn 19 passing through the opening 18 is guided to distribute it over the spool 13 as the spool 13 rotates. The swinging movement of the sphere 15, coupled with the movement of the half sphere 17 causes the yarn 19 to build up on the spool 13 in a symmetrical, pleasing pattern.

In the embodiment of the invention shown in FIG. 3, the yarn winder 110 shown is similar to the yarn winder shown in FIG. 1 and FIG. 2, except that instead of a motor 29 to drive the hemisphere 117 relative to the fixed hemisphere 116, a right angle drive 129 is provided. The right angle drive 129 is fixed to the cradle 125 and it drives the driven pulley 138 through the resilient belt 135, which passes around the drive pulley 136 and idler 137. Thus, the friction wheel 139 is driven by belt 135. As ring gear 120 is rotated, spool 113 rotates and connecting rod 130 rocks cradle 125 causing the thread to be evenly distributed over the spool 113. The resilient belt 135 will stretch sufficiently to allow the sphere to oscillate.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A yarn winder comprising, a support, a stem rotatably fixed to said support, a ring gear and pinion adapted to rotate the stem relative to said support, a yoke adapted to support a sphere, a sphere having a fixed hemisphere and a rotatable hemisphere, said fixed hemisphere being fixed to said yoke and said rotatable hemisphere being rotatable about an equator line of said fixed hemisphere, said stem extending through a slot in said fixed hemisphere and a slot in said yoke, a spool on said stem inside said sphere, a connecting rod, pivot means connecting a first end of said connecting rod to said yoke and a second end of said connecting rod connected to said ring gear adjacent the periphery thereof, rotating means on said yoke driving said rotatable hemisphere along said equator line, a hole in said rotatable hemisphere disposed on a radius displaced approxmately five (5) degrees from a radius perpendicular to said equator, said hole being adapted to receive a thread to be wound on said spool, said equator of said sphere being adapted to rock relative to said stem as said pinion rotates said spool whereby said thread is distributed over said spool.

2. The yarn winder recited in claim 1 wherein said rotating means comprises, a motor.

3. The yarn winder recited in claim 1 wherein said rotating means comprises, a resilient belt driven from said stem and engaging means on the friction wheel driving said spool.

4. The yarn winder recited in claim 1 wherein said hole in said rotation half is offset approximately five (5°) degrees from the center of the curved side of said rotation hemisphere.

5. The yarn winder recited in claim 4 wherein said rotation means comprises, a resilient belt driven from said stem and engaging means on said friction wheel driving said spool, said resilient belt is driven from a pulley on said stem.

* * * * *